US010234216B2

(12) United States Patent
Van Ballekom et al.

(10) Patent No.: US 10,234,216 B2
(45) Date of Patent: Mar. 19, 2019

(54) VALVE ARRANGEMENT FOR A HEAT TREATMENT APPARATUS

(71) Applicant: Tetra Laval Holdings & Finance S.A., Pully (CH)

(72) Inventors: Johannes Van Ballekom, Cobbitty (AU); Bo Olsson, Malmo (SE); Staffan Vestberg, Loberod (SE)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 680 days.

(21) Appl. No.: 14/765,293

(22) PCT Filed: Jan. 22, 2014

(86) PCT No.: PCT/EP2014/051211

§ 371 (c)(1),
(2) Date: Jul. 31, 2015

(87) PCT Pub. No.: WO2014/118047

PCT Pub. Date: Aug. 7, 2014

(65) Prior Publication Data

US 2016/0003560 A1 Jan. 7, 2016

(30) Foreign Application Priority Data

Feb. 1, 2013 (SE) ..... 1350125

(51) Int. Cl.
*F28F 9/26* (2006.01)
*F28F 27/02* (2006.01)
(Continued)

(52) U.S. Cl.
CPC ..... *F28F 9/26* (2013.01); *F17D 3/01* (2013.01); *F28F 27/02* (2013.01); *F28D 2021/0042* (2013.01)

(58) Field of Classification Search
CPC .... F28F 9/26; F28F 27/02; F17D 3/01; F28D 2021/0042
See application file for complete search history.

(56) References Cited

U.S. PATENT DOCUMENTS 3,538,716 A * 11/1970 Matthies ..... F25B 13/00 62/203
5,140,827 A * 8/1992 Reedy ..... F25B 13/00 62/174

(Continued)

FOREIGN PATENT DOCUMENTS

CN 1646863 A 7/2005
DE 195 21 256 C1 12/1996

(Continued)

OTHER PUBLICATIONS

International Search Report (PCT/ISA/210) dated Apr. 16, 2014, by the Swedish Patent Office as the International Searching Authority for International Application No. PCT/EP2014/051211.

*Primary Examiner* — Tho V Duong
(74) *Attorney, Agent, or Firm* — Buchanan Ingersoll & Rooney PC

(57) ABSTRACT

A valve arrangement comprising a number of valves is provided. The valve arrangement is configured to be in a first mode and a second mode. In the first mode sections in a heat treatment apparatus are passed by a product in a first order, and in the second mode the sections are passed in a second order. Since the first order is different from the second order, the first order can be used for full capacity production and the second order can be used for half capacity production.

9 Claims, 7 Drawing Sheets

(51) Int. Cl.
*F17D 3/01* (2006.01)
*F28D 21/00* (2006.01)

(56) References Cited

U.S. PATENT DOCUMENTS

| | | | | |
|---|---|---|---|---|
| 5,168,920 | A | 12/1992 | Brauer et al. | |
| 5,819,551 | A * | 10/1998 | Fukumoto | B60H 1/00907 62/324.1 |
| 6,931,879 | B1 * | 8/2005 | Wiggs | F24J 3/083 165/45 |
| 2003/0049356 | A1 | 3/2003 | Nielsen et al. | |
| 2005/0236136 | A1 * | 10/2005 | Veltkamp | F24F 12/001 165/4 |
| 2007/0039336 | A1 * | 2/2007 | Wu | F25B 1/04 62/160 |
| 2007/0130967 | A1 * | 6/2007 | Park | F25B 13/00 62/151 |
| 2008/0184715 | A1 * | 8/2008 | Chen | F25B 47/022 62/81 |
| 2009/0293519 | A1 * | 12/2009 | Hayashi | F25B 41/062 62/222 |
| 2012/0067070 | A1 * | 3/2012 | Albertson | F25B 13/00 62/126 |
| 2012/0085517 | A1 | 4/2012 | Martin et al. | |

FOREIGN PATENT DOCUMENTS

| | | | |
|---|---|---|---|
| DE | 20 2005 021462 | U1 | 3/2008 |
| EP | 0 462 440 | A1 | 12/1991 |
| EP | 2 442 061 | A2 | 4/2012 |
| GB | 1 027 847 | A | 4/1966 |
| WO | WO 94/09652 | A1 | 5/1994 |

* cited by examiner

VALVE ARRANGEMENT FOR A HEAT TREATMENT APPARATUS

TECHNICAL FIELD

The invention generally relates to the field of heat treatment. More particularly, the invention relates to a valve arrangement for a heat treatment apparatus providing for improved flexibility, in turn providing for more energy efficient and environmental friendly processing as well as consistent product quality when running at different capacities.

BACKGROUND OF THE INVENTION

Today food producers are striving to reduce energy consumption in order to decrease costs as well as provide food products processed in an environmental friendly way. There are different ways to achieve these objectives. One straight forward way is to use components using less electricity, steam, water etc. For instance, by replacing an old tubular heat exchanger with a new energy optimized one the amount of energy needed for heat treating the food product can be reduced. Another way to reduce the energy consumption is to increase the line efficiency. This may for instance be made by designing the line in clever way such that less water and detergents are needed for cleaning the line. Still another way is to provide more flexible components and line solutions such that appropriate conditions for a wider range of combinations of products and/or volumes can be achieved. For instance, if a food producer today would like to run his plant at half capacity, this may not be possible if the line is not built to be run at half capacity. In other cases, it may be possible to run at half capacity, but by using more than half of the energy used when running full capacity, this in practice does not make this a feasible alternative. Further, in many cases, there is an increased risk that the food product is processed non-optimal when running at a capacity lower than full capacity, in turn resulting in increased product losses.

One piece of equipment that has historically been difficult to make in a way such that it can be used for different capacities is a heat treatment apparatus, e.g. tubular heat exchanger. The heat treatment apparatus most often comprises sections for pre-heating, holding, final heating and cooling. It has proven difficult to design such an apparatus being capable of running at different capacities without affecting the product quality negatively.

SUMMARY

Accordingly, the present invention preferably seeks to mitigate, alleviate or eliminate one or more of the above-identified deficiencies in the art and disadvantages singly or in any combination and solves at least the above mentioned problems.

According to a first aspect a valve arrangement is provided. The valve arrangement comprises a number of valves, wherein said valve arrangement is configured to be in a first mode and a second mode, wherein in said first mode a number of sections of a heat treatment apparatus is passed by said product in a first order, and wherein in said second mode said number or sections is passed in a second order, wherein said first order is different from said second order.

The valve arrangement may comprise four valves.

The number of valves may be placed less than 2 meter from each other.

The first mode may be used for a first capacity, such as full capacity, and said second mode may be used for a second capacity, such as half capacity.

The number of valves may be valves enabling said valve arrangement to be in an intermediate mode between said first mode and said second mode.

According to a second aspect it is provided a heat treatment apparatus for heat treating a product in a number of sections. The number of sections may comprise a first heating section, and a second heating section, wherein said heat treatment apparatus by using a first valve arrangement according to the first aspect is configured to be in a first mode or in a second mode, wherein in said first mode said number of sections are passed by said product in a first order being said first heating section followed by said second heating section, wherein in said second mode said number of sections are passed by said product in a second order being said second heating section followed by said first heating section.

The second heating section in said second mode may be deactivated by redirecting a heat transfer media using a valve.

A heat transfer medium used in said first heating section may be capable of increasing a product temperature to a pre-heat treatment temperature.

A heat transfer medium used in said second heating section may be capable of increasing said product temperature to a final heat treatment temperature.

The product temperature when entering said second heating section may be higher in said first mode than in said second mode.

The number of sections further comprising a holding section, and a cooling section, wherein said heat treatment apparatus by using a second valve arrangement is configured to be in said first mode or in said second mode, wherein in said first mode said number of sections are passed by said product in a first order being said first heating section followed by said second heating section followed by said holding section followed by said cooling section, wherein in said second mode said number of sections are passed by said product in a second order being said second heating section followed by said first heating section followed by said cooling section followed by said holding section.

The heat treatment apparatus may be a tubular heat exchanger.

The first valve arrangement may comprise four valves.

The second valve arrangement may comprise four valves.

The first valve arrangement and said second valve arrangement may be identical.

According to a third aspect it is provided a heat treatment apparatus for heat treating a product in a number of sections, said number of sections comprising a holding section, and a cooling section, wherein said heat treatment apparatus by using a second valve arrangement according to the first aspect is configured to be in a first mode or in a second mode, wherein in said first mode said number of sections are passed by said product in a first order being said holding section followed by said cooling section, wherein in said second mode said number of sections are passed by said product in a second order being said cooling section followed by said holding section.

The number of sections may further comprise a first heating section, and a second heating section, wherein said heat treatment apparatus by using a first valve arrangement is configured to be in said first mode or in said second mode, wherein in said first mode said number of sections are passed by said product in said first order being said first heating section followed by said second heating section followed by said holding section followed by said cooling section, wherein in said second mode said number of sections are passed by said product in said second order being said second heating section followed by said first heating section followed by said cooling section followed by said holding section.

According to a fourth aspect it is provided a food processing system comprising a heat treatment apparatus according to the second aspect.

According to a fifth aspect it is provided a method for processing a product using a heat treatment apparatus according to the second aspect.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, wherein.

DETAILED DESCRIPTION OF PREFERRED EMBODIMENTS

Figure 1A:
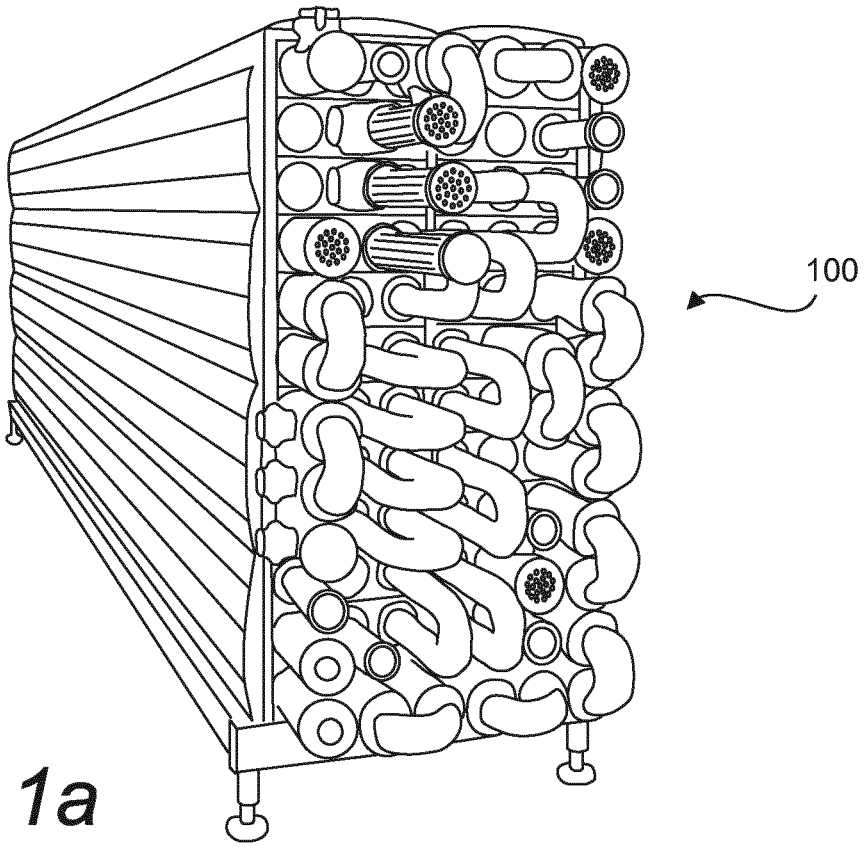
FIGS. 1*a* and 1*b* illustrates an example of a tubular heat exchanger.
Figure 1B:
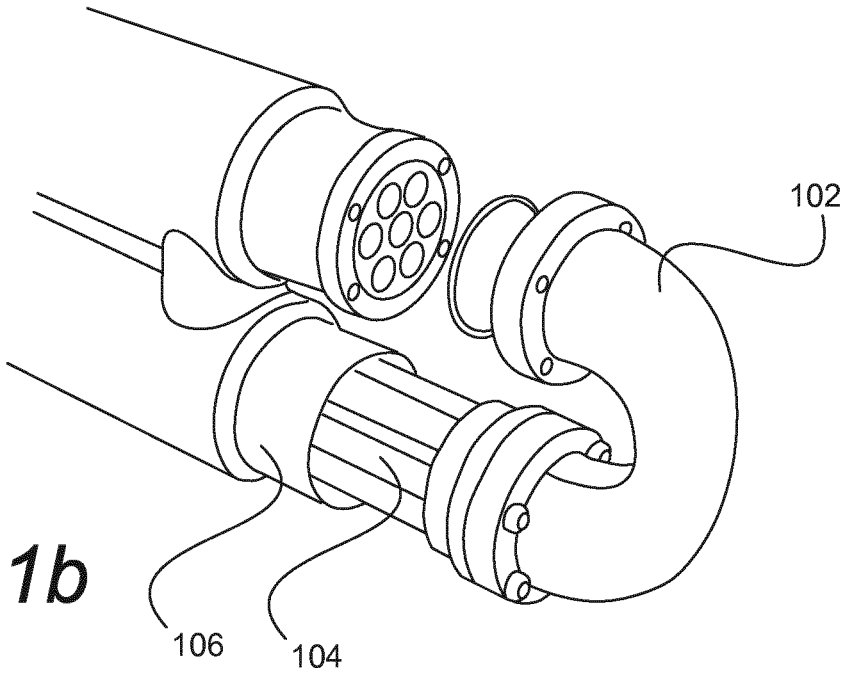

FIGS. 1*a* and 1*b* illustrates an example of a tubular heat exchanger 100, more particularly a Tetra Spiraflo™ marketed by Tetra Pak. As illustrated, a number of tubes are connected to each other via bend pipes 102 providing for a compact design. In the illustrated example, inner tubes 104 are kept in sets and each set is arranged in a bigger pipe referred to as a shell 106. The food product is fed through the inner tubes and a heat transfer medium is fed through the shell. In order to keep energy consumption low, it is advantageous to use outgoing food product, which is to be cooled down before being stored, as the heat transfer medium. Such systems are often referred to as regenerative systems.

Figure 2:
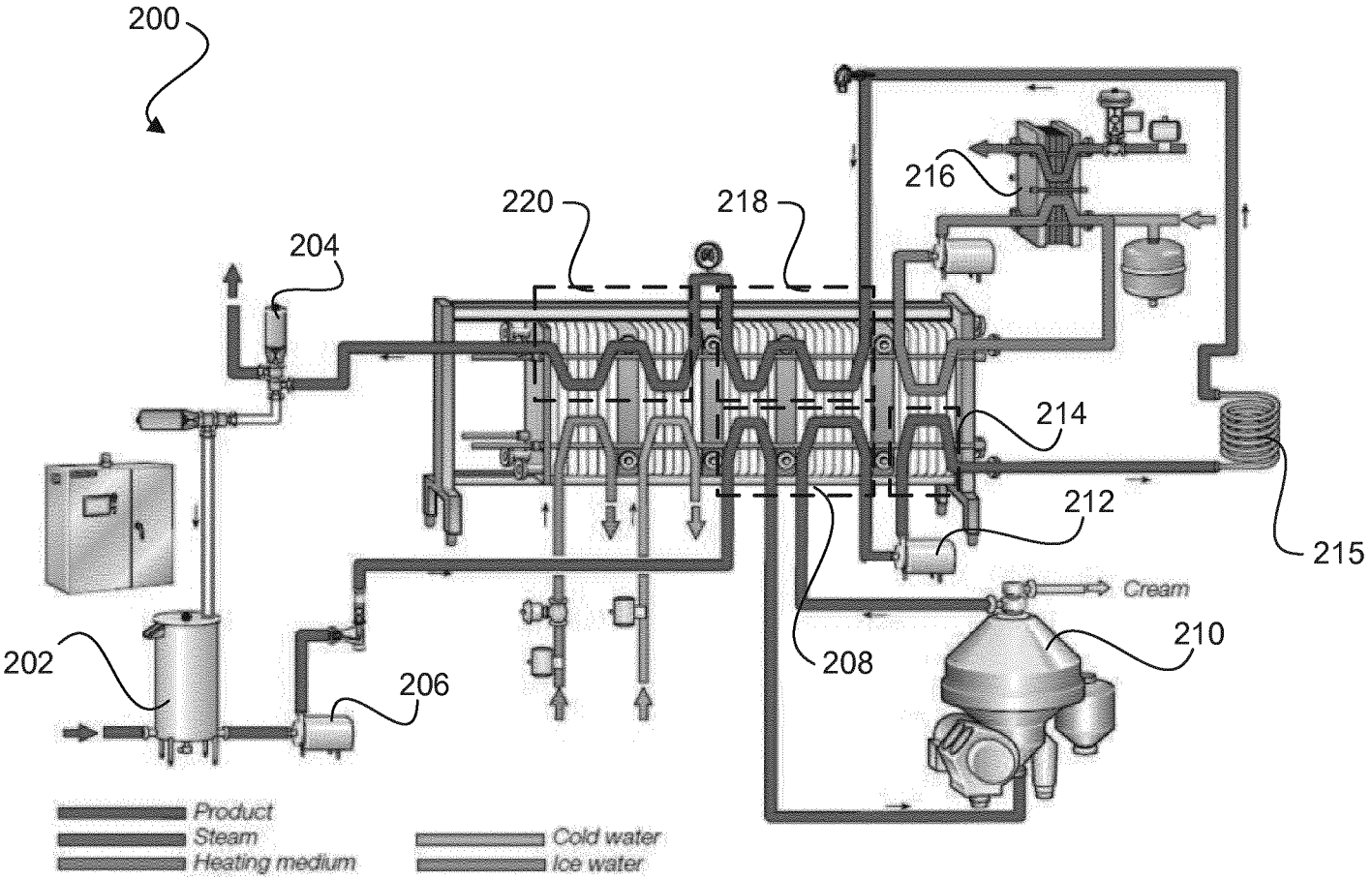
FIG. 2 illustrates an example of a pasteurizer system.

FIG. 2 illustrates an example of a pasteurizer line 200. In this particular example a plate heat exchanger is used. Most often a plate heat exchanger is used for pasteurization lines and tubular heat exchangers are used for ultra high temperature (UHT) lines. One reason for this is that the increased fouling in UHT lines can be better handled by a tubular heat exchanger.

As illustrated, a balance tank 202 is used for storing the milk. In order to make sure that there is product to be processed at all times a flow dispersion valve 204 may be used such that outgoing product can be fed back into the balance tank if the level in the tank is below a threshold level.

A feed pump 206 is arranged to feed product to a pre-heating section 208. In this pre-heating section 208 the temperature is in this example raised to 55 degrees C. before it is fed to a clarifier 210 and then back to the pre-heating section for further heat treatment. In order to reduce the energy consumption the pasteuriser line can be arranged such that pre-heating section 208 is connected to a cooling section placed downstream such that the energy, in the form heat, is transferred from the outgoing product to be cooled down to the incoming product to be heated. Such a system is known as a regenerative system.

After having been pre-heated the product is fed, using a booster pump 212, to a heating section 214, also known as a final heater. Commonly, in a pasteurizer line for milk the temperature is raised to 72 degrees or slightly above. In order to heat the product in the heating section 214 hot water may be used. A sub-system 216 for providing hot water may comprise of a plate heat exchanger, a tank and a pump.

After having heated the product in the heating section 214 the product is fed to a holding cell 215 in order to make sure that the product is held at the high temperature for certain period of time. In a milk pasteurizer it is common to hold at 72 degrees C. for 15-20 seconds.

Next, after having made sure that the product has been heat treated properly, that is, making sure that unwanted microorganisms are killed, the product is fed to a first cooling section 218 in which the product is cooled down. As described above, the first cooling section 218 may be arranged such that a heat transfer can take place between the pre-heating section 208 and the cooling section 218 in order reduce the energy consumption.

In order to further reduce the temperature a second cooling section 220 can be provided. Unlike, the first cooling section 218, the temperature of the product is reduced by using an external media, such as cold water and/or ice water.

Further details of a pasteurizer line can be found in Dairy Processing Handbook, Second edition, 2003, ISBN 91-631-3427-6, published by Tetra Pak Processing Systems AB. Particularly, Chapter 7 "Designing a process line" may be of interest for anyone interested in further details on pasteurizer lines.

Figure 3:
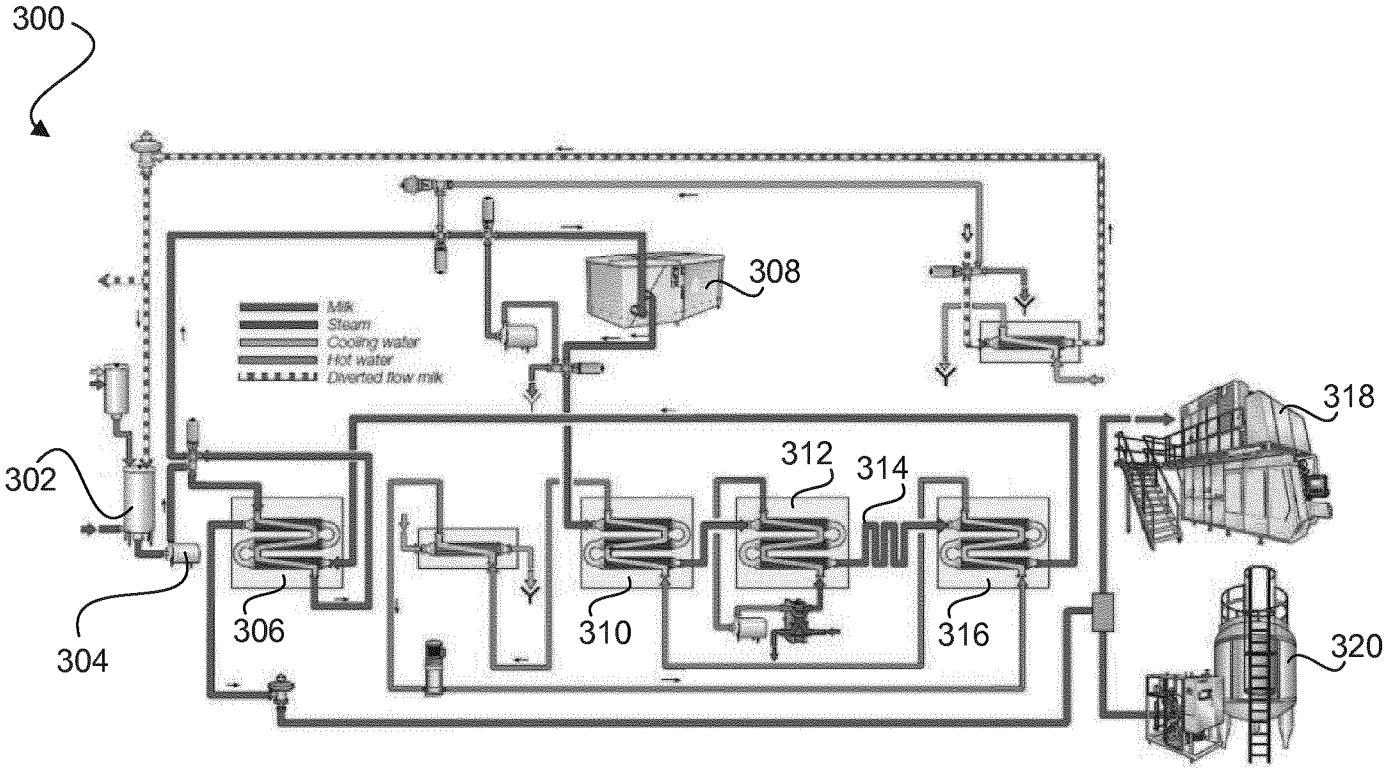
FIG. 3 illustrates an example of a ultra high temperature (UHT) system.

FIG. 3 illustrates an example of a UHT system 300 based on tubular heat exchangers.

Product is fed to a balance tank 302. By using a feed pump 304 the product is fed from the balance tank to a first tubular heat exchanger section 306 pre-heating the product regeneratively, i.e. by making use of the energy released from the outgoing product to be cooled down. With reference to FIGS. 1*a* and 1*b*, the product being pre-heated is usually fed in a space between the inner tubes 104 and the shell 106 and the product being cooled down is fed in the inner tubes 104.

After being pre-heated, in this particular example to 75 degrees C., the product is fed via a valve to a homogeniser 308. Since the product has not been heat treated yet a non-aseptic homogeniser can be used, that is, a homogeniser not fully complying the strict aseptic standard for aseptic homogenisers. In turn this means that a less complex, and hence less costly, homogenizer can be used. However, since the product will be heat treated afterwards no compromises regarding food safety is made.

An advantage of pre-heating and heating the product in two or more steps is, besides that regenerative systems can be used, that steps, such as homogenization, can take place between these two or more steps. This means that e.g. homogenization can be chosen to take place at an optimal temperature.

After having homogenized the product it is fed to a second tubular heat exchanger section 310 in which the temperature is increased further. Unlike the first tubular heat exchanger section 306, hot water is chosen as heat transfer medium. Next, in a third tubular heat exchanger section 312 the temperature can be increased even further to e.g. 135-140 degrees C. for a few seconds. In order to make sure that the temperature is kept for a predetermined period of time such that unwanted microorganisms are killed and that wanted properties of the product is achieved a holding cell 314 can be used.

Thereafter, in a fourth tubular heat exchanger section 316 the product is cooled down in a first step before it is fed to the first tubular heat exchanger section 306 in which it is further cooled down. As described above, the released heat may be used for pre-heating the product earlier in the process.

Finally, the product is fed to an aseptic filling machine 318 or an aseptic tank 320.

For further details reference is made to Dairy Processing Handbook, Second edition, 2003, ISBN 91-631-3427-6, published by Tetra Pak Processing Systems AB, particularly, Chapter 9 "Long-life milk".

Figure 4:
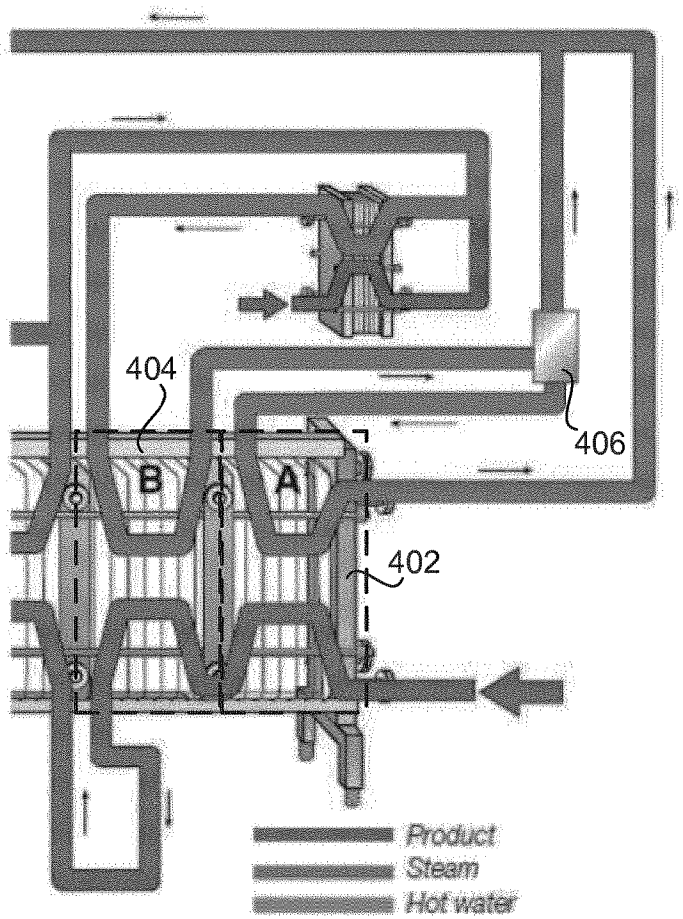
FIG. 4 illustrates so-called split heating.

Today, when a heat treatment system, pasteurizer line or UHT line, should compensate for a capacity decrease of product an approach is to use so-called split heating. FIG. 4 illustrates part of a plate heat exchanger 400 in order to provide an example of how split heating may be used.

Incoming product is fed via a first heating section 402 and thereafter a second heating section 404. In order to reduce the time the product is above 100 degrees, or any other temperature considered to give rise to changed product properties, a heating medium, such as hot water or steam, is by-passed the first section 402 by using a valve 406. In this way, the temperature is not increased in the first section 402. For instance, if the temperature of the product is 75 degrees C. when entering the first section 402 this will be kept until entering the second section 404.

Figure 5:
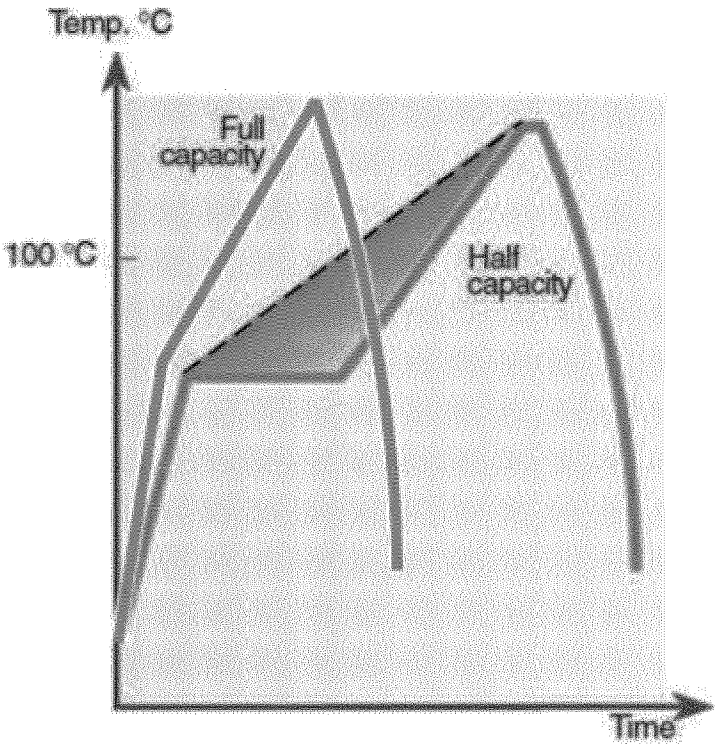
FIG. 5 is a diagram illustrating product temperature over time for full capacity and half capacity.

FIG. 5 illustrates a graph showing temperature over time for a full capacity situation and a half capacity situation. Since the flow is higher in a full capacity situation the time is about half of the time compared to the half capacity situation. As can be seen from the figure, in the half capacity situation the temperature is maintained for a first period of time and then increased. The first period of time is the time it takes for the product to pass the first section 402.

The dotted line illustrates a half capacity situation not using split heating, that is, not having the valve 406. As can be seen from the figure, the temperature is then increased already when the product is in the first section. Due to that the product will be heated above 100 degrees, which by many food producers is considered to be a temperature above which the product properties, like taste, are affected, the product properties will be affected to a higher degree when no split heating is used. However, as can be seen from the figure, even though split heating is used the product will during the half capacity situation be exposed to high temperatures, like 100 degrees C. and above, for a longer period of time compared to the full capacity situation. The effect of this is that product properties may differ slightly when running at half capacity and full capacity. By using split heating the differences can be mitigated.

Figure 6A:
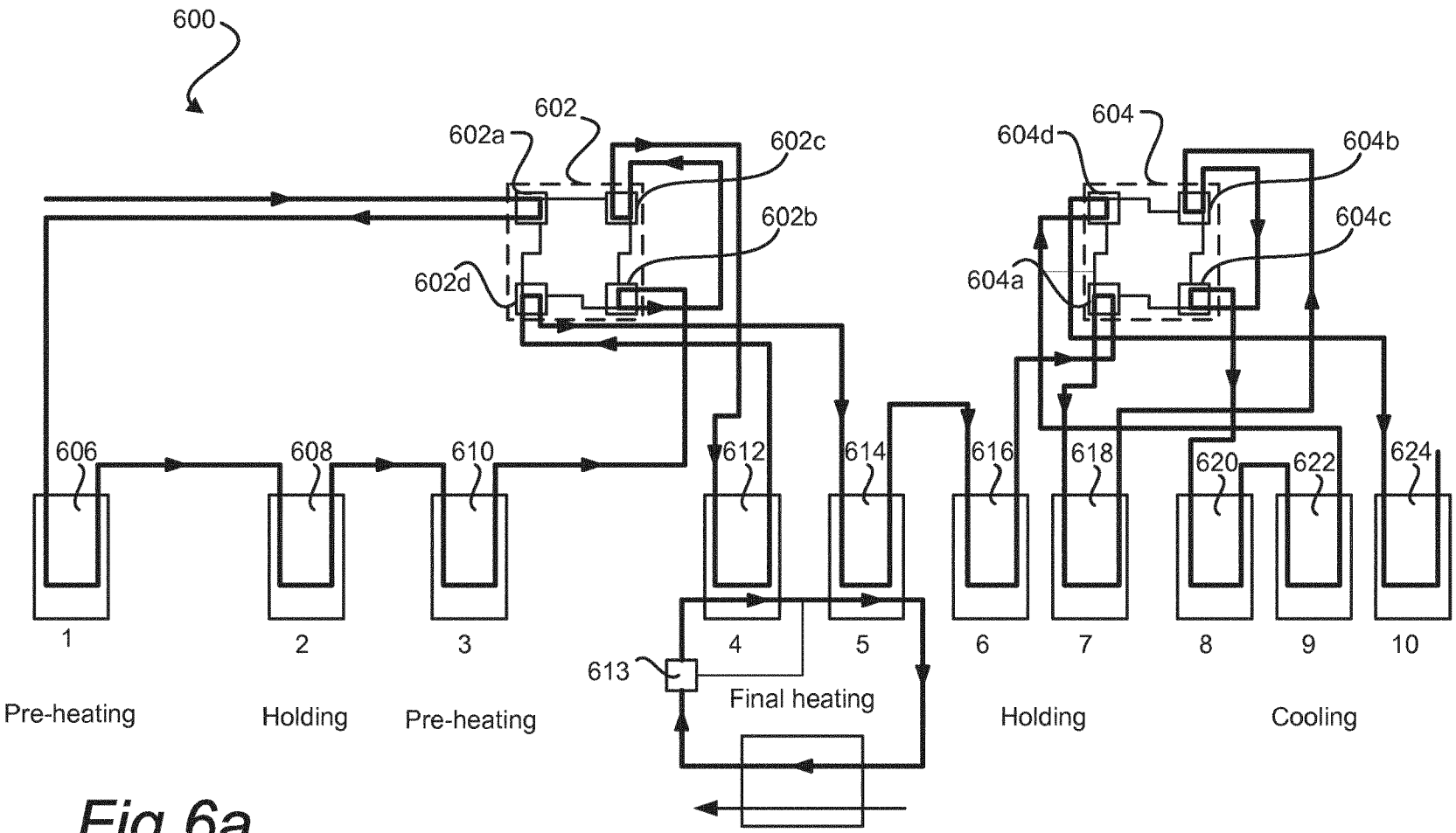
FIG. 6*a* illustrates an example of a heat treatment apparatus in a first mode for processing product in at a full capacity.

FIG. 6*a* illustrates generally a heat treatment apparatus 600, comprising for instance a tubular heat exchanger or a plate heat exchanger, provided with a number of sections.

In order to be able to run at full capacity and half capacity without giving rise to different product properties a first valve arrangement 602 and a second valve arrangement 604 can be used.

In FIG. 6*a*, illustrating a full capacity situation with the first valve arrangement 602 and the second valve arrangement 604 in a first mode, product is fed into the heat treatment apparatus from e.g. a homogenizer to the first valve arrangement 602. As illustrated by the arrows, the product is fed via the valve arrangement 602, more particularly via a first valve 602*a* to a first section 606 used for pre-heating the product. Next from the first section 606, the product is fed to a second section 608 used as a holding cell, then to a third section 610 used for pre-heating the product further before feeding the product back to the first valve arrangement 602, more particularly a second valve 602*b*. From the second valve 602*b* the product is fed to a third valve 602*c*. Next, from the third valve 602*c* and the first valve arrangement 602 the product is fed to a fourth section 612 used as a final heating section. From the fourth section 612 the product is fed back to the first valve arrangement 602, more particularly to a fourth valve 602*d*. Next, from the first valve arrangement 602 the product is fed to a fifth section 614 used as a final heating section, then to a sixth section 616 used as a holding cell, before it is fed to the second valve arrangement 604, more particularly a first valve 604*a*. From the second valve arrangement 604 the product is fed to a seventh section 618 used as a holding cell and then back to the second valve arrangement 604, more particularly a second valve 604*b*, feeding the product to a third valve 604*c*. From the second valve arrangement 604, the product is fed to an eighth section 620 used as cooling section, then to a ninth section 622 also used as a cooling section. Next, the product is fed to the second valve arrangement 604, more particularly a fourth valve 604*d*, and from there to a tenth section 624 used as a cooling section.

As illustrated, the first valve arrangement 602 and the second valve arrangement 604 may be identical. A positive effect of this is that less different parts need to be kept in stock.

Figure 6B:
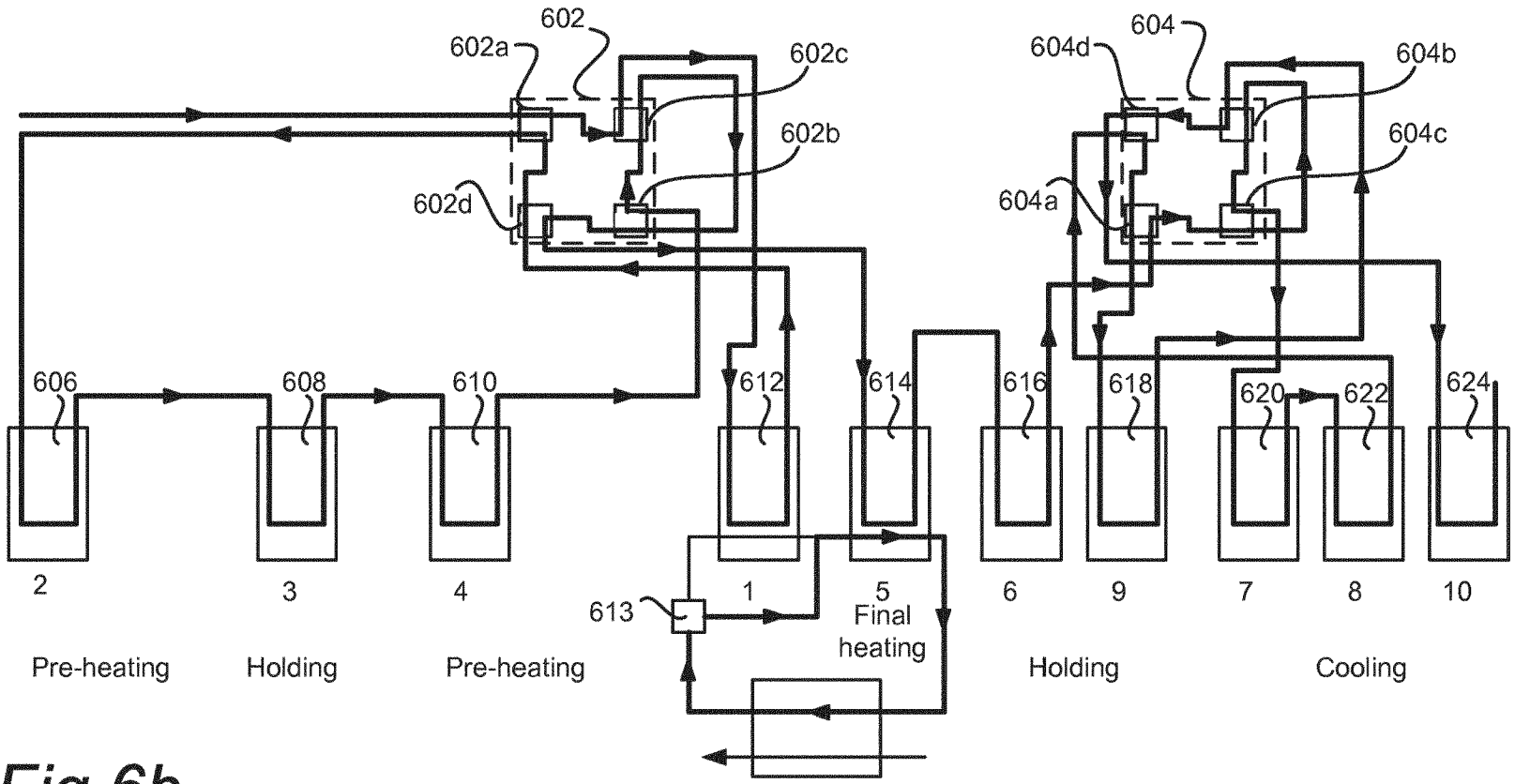
FIG. 6*b* illustrates the heat treatment apparatus as in FIG. 6*a* in a second mode for processing product at a half capacity.

FIG. 6*b* illustrates the same heat treatment apparatus as in FIG. 6*a*. However, in FIG. 6*b* the first valve arrangement 602 and the second valve arrangement 604 are changed into a second mode such that the heat treatment apparatus is adapted to run at half capacity without affecting the product properties negatively by holding the product at high temperatures, such that 100 degrees C. and above, for a longer period of time compared to when running at full capacity.

As illustrated, both the four valves of the first valve arrangement 602 and the four valves of the second valve arrangement 604 have been changed.

By changing the valves in the valve arrangements the product is fed through the different sections in another order making it possible to make sure that the product is not kept above the high temperatures, giving rise to changed product properties, for a longer period of time compared to the full capacity situation.

The different sections are named in the same way as in the full capacity situation illustrated in FIG. 6*a*. For illustrative purposes and for making it easier to follow the order in which the sections are passed by the product in the half capacity situation numbers are introduced below the different sections indicating the order in which they are passed by the product.

Incoming product is fed to the first valve arrangement 602, more particularly the first valve 602*a*, in turn feeding to the third valve 602*c*, and from there to the fourth section 612, herein used only as a transport section. As illustrated in FIG. 6*a*, the fourth section 612 is used as a final heating section in the full capacity situation. In the half capacity situation, since the temperature of the product will not change due to that heating media is bypassed the fourth section 612 by using a valve 613, similar to the valve 406 illustrated in FIG. 4, this section will function as a-transport section. By not heating the product in the fourth section 612 and since the product is relatively cold (e.g. less than 85°) when entering the fourth section 612, the product will not reach temperatures negatively affecting the product properties in this section, which is an advantage since this provides for that it is possible to provide the same product properties in the half capacity situation as in the full capacity situation.

After having being transported through the fourth section 612 the product is fed back to the first valve arrangement 602, more particularly the fourth valve 602*d* and then to the first valve 602*a*, and from there to the first section 606 used as pre-heating section. From the first section 606 the product is fed to a second section 608 used as a holding cell. Next, the product is fed to a third section 610 used as pre-heating section and from there back to the first valve arrangement 602, more particularly a second valve 602*b*, then to a third valve 602*c*, back to the second valve 602*b* and then to the fourth valve 602*d*. From the first valve arrangement 602 the product is fed to the fifth section 614 used as a final heating section, which is also the case for the full capacity situation illustrated in FIG. 6*a*.

From the fifth section 614 the product is fed to sixth section 616 used as a holding cell. Next, the product is fed to the second valve arrangement 604, more particularly the first valve 604*a* feeding to the third valve 604*c*, in turn feeding to the second valve 604*b*, in turn feeding back to the third valve 604*c*. From there, the product is fed to the eighth section 620 used as a cooling section, then to the ninth section 622, used as a cooling section. Then, the product is fed back to the second valve arrangement 604, more particularly to the fourth valve 604*d*, in turn feeding to the first valve 604*a*, and from there to the seventh section 618 used as a holding cell, but now since the product has already been cooled down in the eighth section 620 and the ninth section 622 below high temperatures affecting the procut properties the change in product properties are limited. From the seventh section 618 the product is fed back to the second valve arrangement 604, more particularly to the second valve 604*b*, in turn feeding to the fourth valve 604*d*. Finally, the product is fed from the second valve arrangement 604 to the tenth section 624 used as a cooling section.

Hence, by using the first valve arrangement 602 one of the two final heating sections used for full capacity is used for transport when running at half capacity. Further, by using the second valve arrangement only one of the two sections used as holding cells for holding the temperature of the product when leaving the final heating sections, e.g. 135-140 degrees, in the full capacity situation is used in the half capacity situation for the same purpose. The other section is also used as a holding cell, but after the product has been cooled down. The positive effect of this is that the product will not be kept at high temperatures negatively affecting product properties for a longer period of time when running at half capacity compared to when running at full capacity.

In order to provide for a smooth transition from one capacity to another, a transition phase can be used. In this phase, the process can be slowed down and the valve arrangements can be changed.

An advantage of using all sections in both the first mode and the second mode is that there are no product caught in any section when switching from one mode to another, which for example reduces the risk that product is caught in heating sections with increased product losses as an effect.

A further advantage is that production down time can be reduced. For example, in some cases the production does not have to be stopped when switching from e.g. full capacity to half capacity. This reduces the need for and time spent on production purges, cleaning, resterilising and product priming.

Figure 7B:
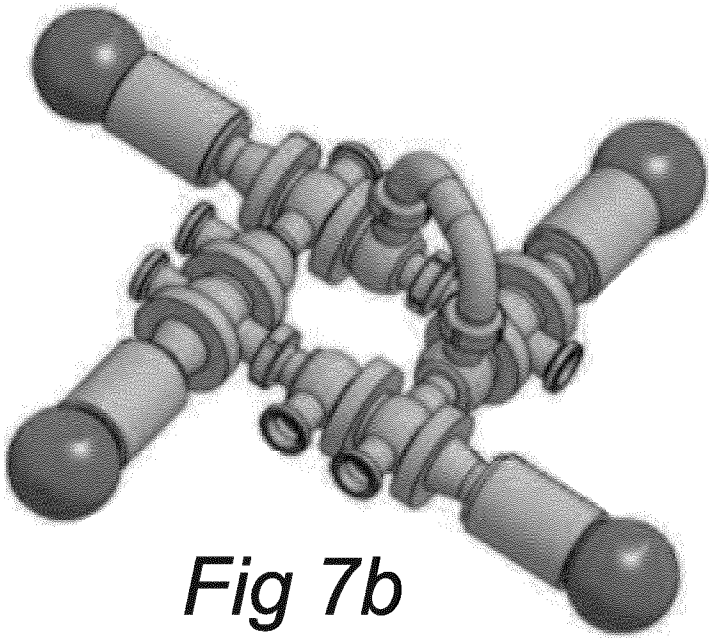
FIGS. 7*a* and 7*b* illustrate different perspective views of a valve arrangement comprising four valves.
Figure 7A:
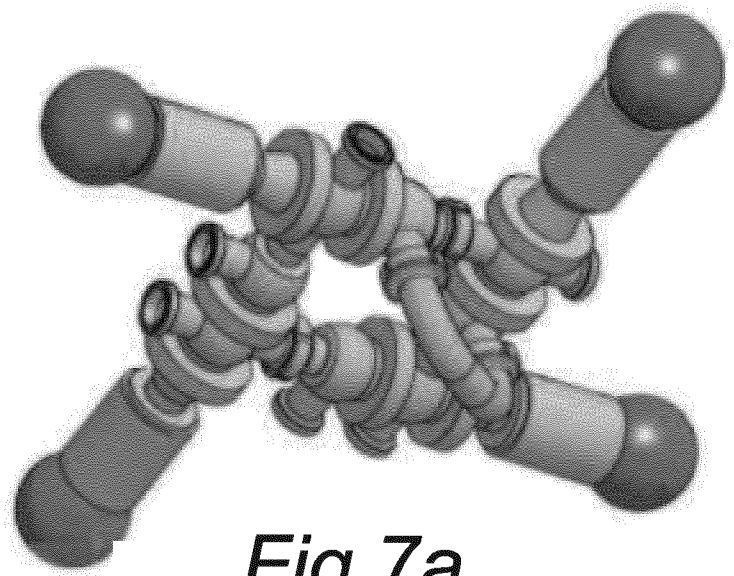

FIGS. 7*a* and 7*b* illustrate by example two different perspective views of the first valve arrangement or the second valve arrangement.

Both valve arrangements may comprise four connected valves. The valves may be seat valves. Further, the valves may be pneumatically operated.

An advantage of having the valves close together is that less products will be caught between the valves when switching from the first mode for running full capacity to the second mode for running half capacity, or vice versa. In this way product losses can be reduced.

Further, the valves comprised in the first and second valve arrangements do not need to be so-called shut off valves or change over valves. Valves dividing the product flow in different directions can also be used. An advantage of this is that the heat treatment apparatus may be optimised for capacities between half capacity and full capacity.

A further advantage is that the number of tubes in the heat treatment apparatus may be reduced since the same sections may be used for both full capacity and half capacity. Therefore, there is no need for sections specifically intended for either of the capacities.

Further, the first valve arrangement can also be used in combination with an extra final heating section for extending the running time for a heat treatment apparatus. More specifically, when fouling has been built up in the fourth section 612 used a final heating section the first valve arrangement 602 is changed from the first mode to the second mode, thereby using the fourth section 612 as a transport section with the effect that less fouling will be built up due to the lower product temperature. Further, in order to provide for that two final heating sections are available the extra final heating section is activated.

Apart from the examples shown in FIGS. 7*a* and 7*b*, valve arrangements comprising a different number of valves can be used as well. However, choosing a small number of valves can have the advantage that there are less piping between the valves, which affect the amount of product caught in the piping when switching from one capacity to another. A further reason to choose a small number of valves is cost efficiency, since each valve adds an extra cost.

In the examples presented above, full capacity and half capacity are mentioned. The general idea of having valve arrangements for changing the order in which the product passes the different sections in a heat treatment apparatus is however applicable for other capacities as well. In order to make sure that the product properties are affected in the same way, it may be needed to have more or fewer sections. For instance, in case of changing between full capacity and one third capacity, three sections for final heating of the product can be used instead of the two sections, the fourth section 612 and the fifth section 614, used in the example illustrated in FIGS. 6*a* and 6*b*. In the same way, the number of holding cells may be increased to three compared to the two sections, the sixth section 616 and the seventh section 618, illustrated in FIG. 6*a* and FIG. 6*b*. Which set up to choose can be based on available capacities for a filling machine placed downstream.

Even though the examples above are based on tubular heat exchangers and plate heat exchangers, all heat treatment apparatuses with sections can be used.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A heat treatment apparatus for heat treating a product in a number of sections of the heat treatment apparatus, said number of sections comprising at least a separate and distinct first heating section and a separate and distinct second heating section, the heat treatment apparatus comprising a valve arrangement that comprises a number of valves, the valve arrangement being configured to be in a first mode and a second mode, wherein, in the first mode, a number of the sections are configured to be passed by the product in a first order, and in the second mode, said number of the sections are configured to be passed by the product in a second order, the first order being different from the second order, the heat treatment apparatus being configured, by using the valve arrangement, to be in a first mode or in a second mode, wherein, in the first mode of the heat treatment apparatus, said number of the sections are configured to be passed by the product in a first order that comprises the first heating section being followed by the second heating section, wherein, in the second mode of the heat treatment apparatus, said number of sections are configured to be passed by the product in a second order that comprises the second heating section being followed by the first heating section, wherein the second heating section is configured to be, in the second mode of the heat treatment apparatus, deactivated by redirecting a heat transfer media using a valve such that the heat transfer media does not flow to a portion of the second heating section, and wherein, in the first mode of the heat treatment apparatus, the product passes the first heating section and the second heating section in a predetermined flow direction, and wherein, in the second mode of the heat treatment apparatus, the product passes the first heating section and the second heating section in said predetermined flow direction.

2. The heat treatment apparatus according to claim 1, wherein a heat transfer medium arranged to be used in the first heating section is provided to increase a temperature of the product to a pre-heat treatment temperature.

3. The heat treatment apparatus according to claim 1, wherein a heat transfer medium arranged to be used in the second heating section is provided to increase a temperature of the product to a final heat treatment temperature.

4. The heat treatment apparatus according to claim 1, configured to be operated such that, when the product enters the second heating section, a temperature of the product is higher in the first mode of the heat treatment apparatus than in the second mode of the heat treatment apparatus.

5. The heat treatment apparatus according to claim 1, said number of sections further comprising a holding section, and a cooling section, the heat treatment apparatus being configured, by using a further valve arrangement, to be in the first mode or in the second mode of the heat treatment apparatus, wherein, in the first mode of the heat treatment apparatus, the first order comprises the first heating section followed by the second heating section followed by the holding section followed by the cooling section, wherein, in the second mode of the heat treatment apparatus, the second order comprises the second heating section followed by the first heating section followed by the cooling section followed by the holding section.

6. The heat treatment apparatus according to claim 1, wherein the heat treatment apparatus is a tubular heat exchanger.

7. The heat treatment apparatus according to claim 1, wherein the valve arrangement comprises four valves.

8. The heat treatment apparatus according to claim 5, wherein the further valve arrangement comprises four valves.

9. The heat treatment apparatus according to claim 8, wherein a structure of the valve arrangement and the further valve arrangement are identical.

* * * * *